US006257304B1

(12) United States Patent
Jacobs et al.

(10) Patent No.: US 6,257,304 B1
(45) Date of Patent: Jul. 10, 2001

(54) BI-FOLD DOOR SYSTEM

(75) Inventors: Kenneth Jacobs, Bramrey; Mark R. Flynn, Caterham, both of (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/640,910

(22) Filed: Aug. 18, 2000

(51) Int. Cl.[7] ..... E05D 15/26
(52) U.S. Cl. ..... 160/206
(58) Field of Search ..... 160/206, 207, 160/213, 199, 196.1, 209, 203; 16/94 D, 95 D, 96 D, 277, 286, 289, 304, 306, 308, DIG. 36, 293

(56) References Cited

U.S. PATENT DOCUMENTS

| | | | | |
|---|---|---|---|---|
| 431,349 | | 7/1890 | Hart . | |
| 1,700,184 | | 1/1929 | Sipes . | |
| 2,891,274 | * | 6/1959 | Bloom | 160/206 |
| 3,116,782 | * | 1/1964 | Rudnick | 160/206 X |
| 3,314,534 | * | 4/1967 | Winnan | 160/206 X |
| 3,384,998 | | 5/1968 | Abramson . | |
| 3,683,451 | | 8/1972 | Tanner . | |
| 3,811,489 | * | 5/1974 | Thun et al. | 160/118 |
| 3,849,835 | * | 11/1974 | Jerila | 16/182 |
| 4,463,046 | | 7/1984 | Hutchison et al. . | |
| 4,731,904 | | 3/1988 | Sprague . | |
| 5,133,108 | | 7/1992 | Esnault . | |
| 5,432,676 | | 7/1995 | Satoh et al. . | |
| 5,448,799 | | 9/1995 | Stein, Jr. . | |
| 5,528,424 | | 6/1996 | Lentz et al. . | |
| 5,598,606 | | 2/1997 | Jacobs . | |
| 5,673,516 | | 10/1997 | Hughes et al. . | |
| 5,682,643 | * | 11/1997 | Duffy | 16/265 |
| 5,690,157 | | 11/1997 | Chen . | |
| 5,813,739 | | 9/1998 | White . | |

FOREIGN PATENT DOCUMENTS 2324831 11/1998 (GB) .

* cited by examiner

*Primary Examiner*—David M. Purol
(74) *Attorney, Agent, or Firm*—Pillsbury Winthrop LLP

(57) ABSTRACT

A bi-fold door assembly which includes an overcenter spring-biased hinge assembly comprising first and second hinge members including first and second mounting positions fixedly connected with first and second door panels respectively, interengaging axially aligned hinge portions constructed and arranged to receive a hinge pin therethrough establishing a vertical hinge axis between the two door panels and a spring constructed and arranged to provide oppositely directed spring forces. Each spring is constructed and arranged with respect to the first and second hinge members so that the opposed spring forces provided by the spring are applied to the first and second hinge members to bias the first and second door panels into the closed position when the door panels are near the closed position and to bias the first and second door panels into the opened position when the door panels are near the opened position.

18 Claims, 8 Drawing Sheets

BI-FOLD DOOR SYSTEM

BACKGROUND OF THE INVENTION

Bi-fold door assemblies are known. Basically, a bi-fold door assembly includes first and second door panels. Upper and lower pivot structures are provided at one side of the first door panel which serve to mount the first door panel within a door opening adjacent one side thereof for pivotal movement about a vertical pivotal axis. Upper and lower hinge structures are provided between an opposite side of the first door panel and an adjacent side of the second door panel which serve to hingedly connect the first and second door panels together for relative movement about a vertical hinge axis between a closed position wherein the first and second door panels are disposed generally aligned with one another within the door opening and an opened position wherein the first and second door panels are disposed generally in side-by-side relation to one another adjacent the one side of the door opening. Usually, upper and lower horizontally extending track structures are installed in the door opening and upper and lower guiding structures are provided at an opposite side of the second door panel which serve to guide the opposite side of the second door panel along the horizontally extending track structures. The guiding structures also allow the second door panel to pivot about a moving vertical axis which is movable horizontally as the opposite side of the second door panel moves along the track structures.

There is always a need to provide a bi-fold door assembly which is more cost effective and/or has new operational features.

BRIEF DESCRIPTION OF THE INVENTION

It is an object of the present invention to fulfill the need expressed above. In accordance with one aspect of the present invention, this objective is obtained by providing a door assembly including first and second door panels having upper and lower pivot structures, upper and lower hinge structures and upper and lower guiding structures of the type described wherein each hinge structure includes an over-center spring-biased hinge assembly comprising first and second hinge members including first and second mounting portions fixedly connected with the first and second door panels respectively, interengaging axially aligned hinge portions which serve to receive a hinge pin therethrough establishing the vertical hinge axis and a spring which serves to provide oppositely directed spring forces. The spring is provided with respect to the first and second hinge members so that the oppositely directed spring forces provided by the spring are applied to the first and second hinge members to bias the first and second door panels into the closed position when the door panels are near the closed position and to bias the first and second door panels into the opened position when the door panels are near the opened position. Each spring includes a length of spring wire configured to provide a loop section with end portions extending tangentially therefrom in generally the same direction so that the free ends of the end portions are biased in opposite directions toward one another. The free ends of said spring end portion are bent into L-shaped configurations and connected with the mounting portions. Each mounting portion of the first and second hinge members includes integral resiliently cantilevered, snap-connecting elements constructed and arranged to receive a corresponding spring free end with a snap fit herein.

In accordance with another aspect of the present invention, the aforestated objective is obtained by providing a door assembly including first and second door panels having upper and lower pivot structures, upper and lower hinge structures and upper and lower guiding structures of the type described wherein each guiding structure includes a molded plastic member including a fixed mounting portion which serves to fixedly mounted on the opposite side of the second door panel, a pivoted portion and an elongated thin narrow wall integrally interconnecting the pivoted portion with respect to the fixed portion and establishing the movable vertical axis. Each guiding structure includes track engaging structure slidably engaged with the associated track structure for horizontal sliding movement along the track structure. Each pivoted portion is operatively associated with the associated track-engaging structure so as to move horizontally therewith when the track-engaging structure moves horizontally along the track structure so that the elongated thin narrow wall and the connection of the fixed mounting portion with the opposite side of the second door panel allow the opposite side of the second door panel to pivot about the moving vertical axis established by the elongated thin wall while being moved horizontally thereby as the pivoted portion is moved horizontally with the track-engaging structure.

DETAILED DESCRIPTION OF THE PREFERRED EMBODIMENT OF THE INVENTION

Figure 1:
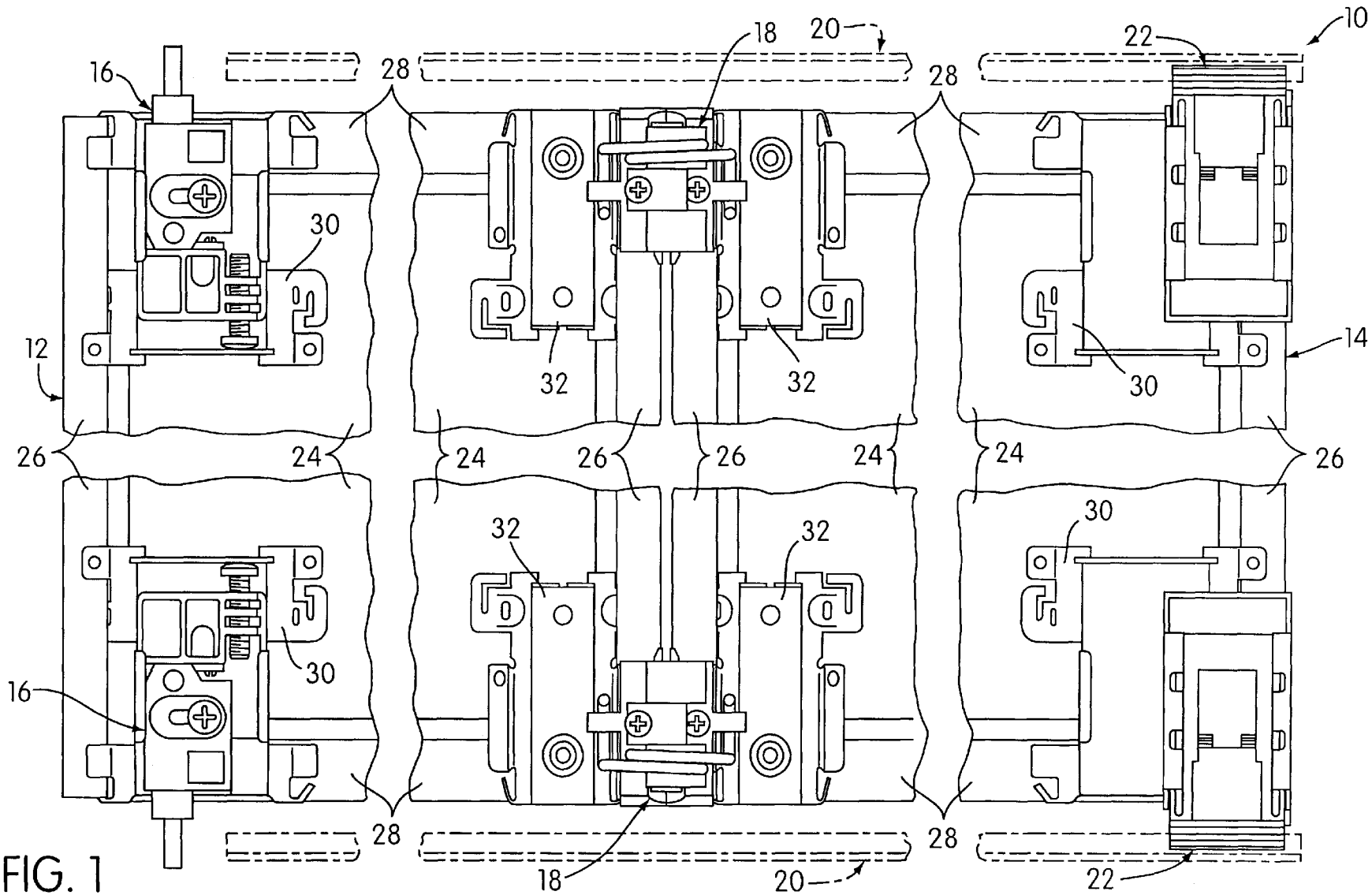
FIG. 1 is a rear elevational view of a bi-fold door assembly embodying the principles of the present invention with the track structures being shown in phantom lines.

Referring now more particularly to the drawings, there is shown in FIG. 1 thereof a bi-fold door assembly, generally indicated at 10, which embodies the principles of the present invention. The bi-fold door assembly includes first and second door panels, generally indicated at 12 and 14 respectively. Upper and lower pivot structures, generally indicated at 16, are disposed at one side of the first door panel 12 and serve to mount the first door panel within a door opening (not shown) adjacent one side thereof for pivotal movement about a vertical pivotal axis. Upper and lower hinge structures, generally indicated at 18, are disposed between an opposite side of the first door panel 12 and an adjacent side of the second door panel 14 to hingedly connect the first and second door panels 12 and 14 together for relative movement about a vertical hinge axis, between a closed position wherein the first and second door panels 12 and 14 are disposed generally aligned with one another within the door opening, as shown in FIG. 1, and an opened position wherein the first and second door panels 12 and 14 are disposed generally in side-by-side relation to one another adjacent the one side of the door opening.

Upper and lower track structures, generally indicated at 20, shown in phantom lines in FIG. 1, are installed in horizontally extending relation within the door opening. Upper and lower guiding structures, generally indicated at 22, are disposed at an opposite side of the second door panel 14 and serve to guide the opposite side of the second door panel along horizontally extending track structures 20. The guiding structure 22 is constructed and arranged to allow the second door panel 14 to pivot about a moving vertical axis which is movable horizontally as the opposite side of the second door panel 14 moves along the track structures 20.

The first and second door panels 12 and 14 may be of any well known construction. For example, each of the door panels 12 and 14 are constructed in accordance with the teachings contained in British Patent 2,324,831, the disclosure of which is hereby incorporated by reference into the present specification. Basically, each door panel 12 and 14 includes an outer decorative panel 24, such as a mirrored glass panel or the like, having trim around the peripheral edges thereof including hollow vertically extending stiles 26, upper and lower horizontal rails 28 secured together by a first pair of upper and lower corner brackets 30 and a second pair of upper and lower corner brackets 32.

The pivot structures 16 may assume any well known constructions. However, as shown, each is preferably constructed in accordance with the principles disclosed in the aforesaid '831 patent. As previously indicated, the upper and lower pivot structures 16 serve to mount the first door panel 12 for pivotal movement about a vertical axis adjacent one side of the first door panel 12 in an adjacent position with respect to one side of the door opening. It will be noted that, in the case of the first door panel 12 which has the pivot structures 16 connected thereto, the corner brackets 30 form a part of the pivot structure 16 in accordance with the teachings of the '831 patent.

Referring now more particularly to FIGS. 2–5, the preferred form of the hinge structures 18 constructed in accordance with the principles of the present invention is shown therein. The upper and lower hinge structures 18 are identical so that a description of one should suffice to provide an understanding of both. The hinge structure 18 includes a pair of hinge members, generally indicated at 34, molded of a suitable plastic material. Each hinge member 34 includes a mounting portion 36 which is adapted to be mounted on an end of an associated stile 26.

Figure 2:
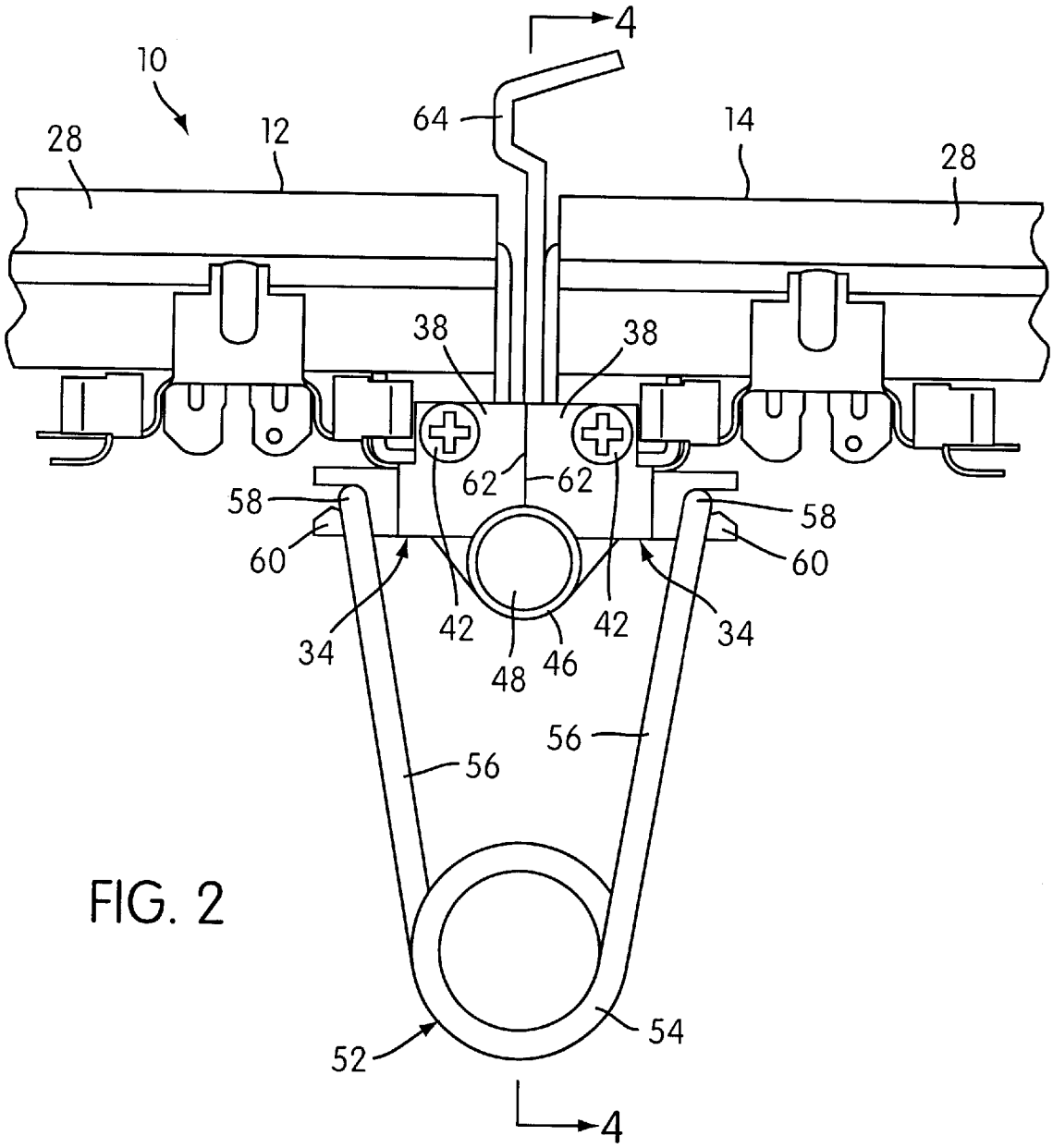
FIG. 2 is an enlarged fragmentary top plan view of the hinge structure on the first and second door panels showing the same in the closed door position thereof.
Figure 3:
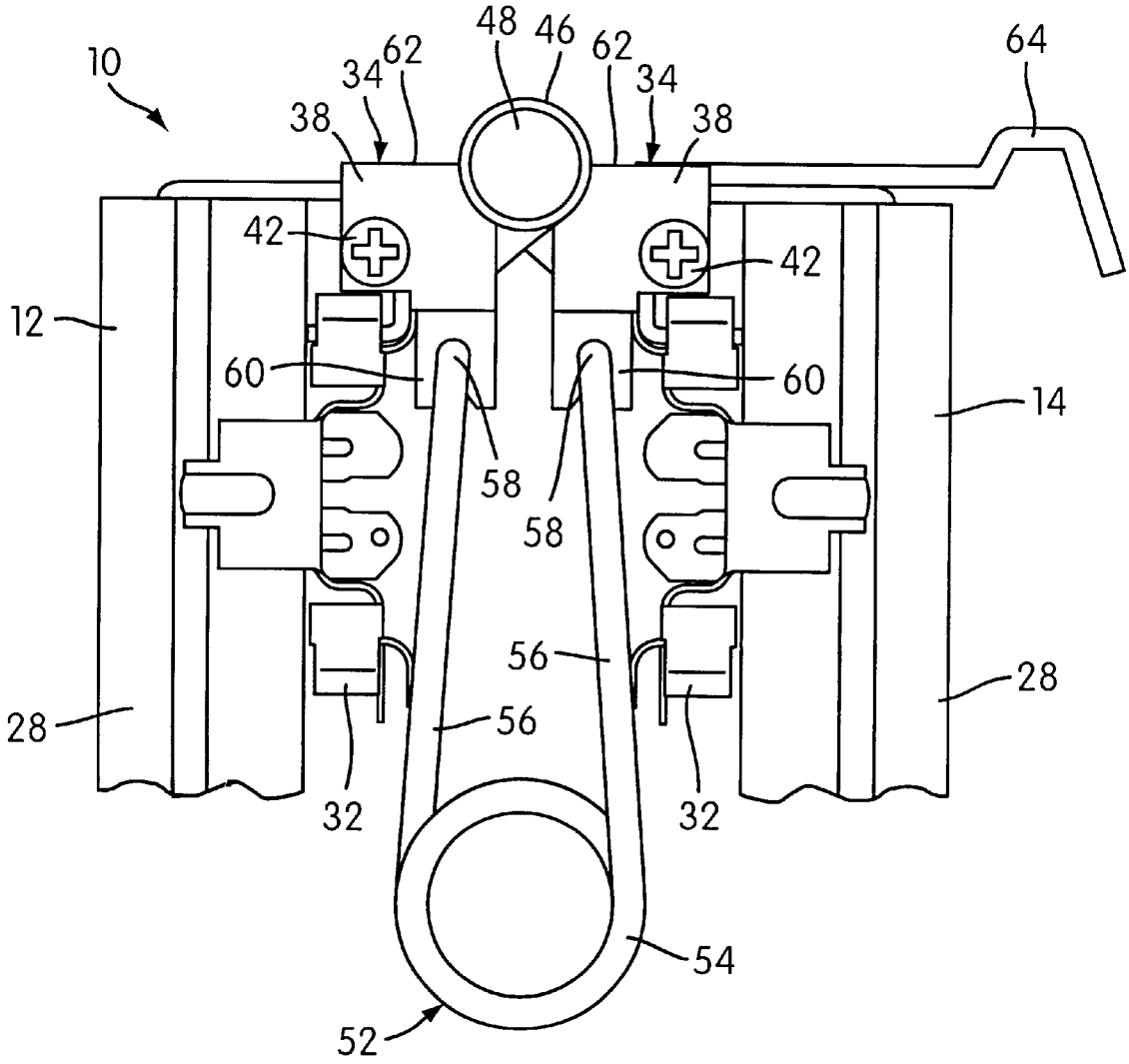
FIG. 3 is a view similar to FIG. 2 showing the hinge structure in the open door position thereof.
Figure 5:
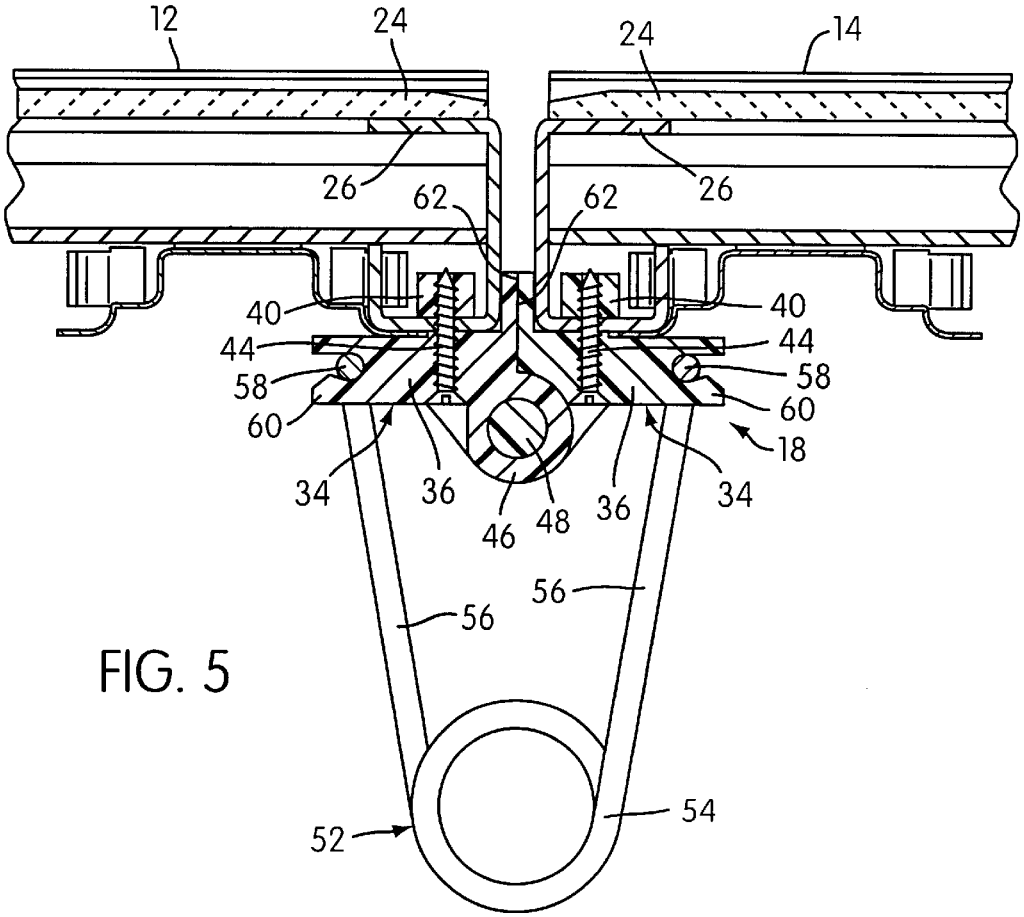
FIG. 5 is a sectional view taken along the line 5—5 of FIG. 4.

As best shown in FIGS. 2, 3 and 5, each mounting portion 36 includes a flange 38 at one end and an elongated mounting block 40 (see FIG. 5) has its end fixed to the flange 38 as by screws 42. In this way, it becomes possible to insert the mounting blocks 40 into the hollow ends of the adjacent vertical stiles 26 of first and second door panels 12 and 14 and then to effect a final fixed securement by threading a screw 44 through each mounting portion 36 and into the associated mounting block 40.

It is noted that the upper and lower hinge structures are identical and securement in the same manner can be achieved irrespective of whether the mounting blocks are inserted downwardly into the hollow upper ends of the rim elements, as in the case of the upper hinge structure, or upwardly into the hollow lower ends of the rim elements as in the case of the lower hinge structure. Moreover, it would be possible to mount each hinge member separately and then join them by inserting the pivot pin.

Figure 4:
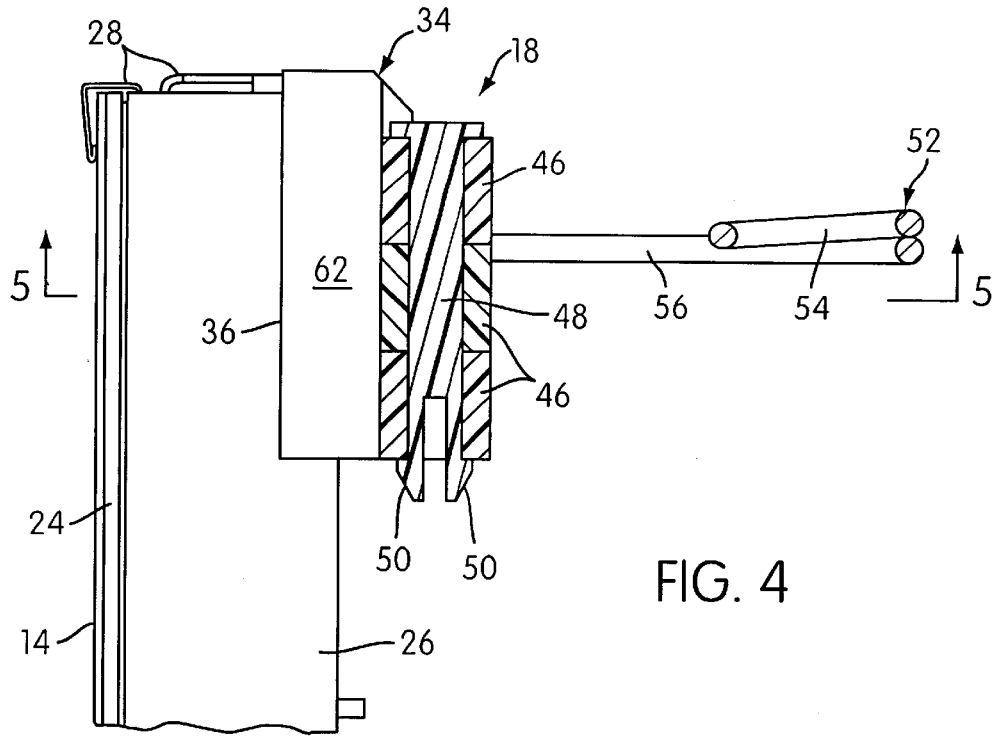
FIG. 4 is a sectional view taken along the line 4—4 of FIG. 2.

The hinge members 34 also include interengaging axially aligned tubular hinge portions 46 constructed and arranged to receive a hinge pin 48 therethrough establishing the vertical hinge axis of the hinge structure. The hinge pin 48 is headed at one end and has a pair of integral resilient cantilevered hook elements 50 at the opposite end thereof. As best shown in FIG. 4, the hook elements 50 enable the hinge pin 48 to be pushed through the aligned hinge portions 46 and snap fitted into the operative position shown. The hinge pin 48 is easily removed by pinching the cantilevered resilient hook elements 50 toward one another and pushing on the same axially to allow the hinge pin 48 to be withdrawn.

The hinge structure 18 also includes a spring, generally indicated at 52, constructed and arranged with respect to the first and second hinge members 34 so that oppositely directed spring forces provided by the spring 52 are applied to the first and second hinge members 34 to bias the first and second door panels 12 and 14 into the closed position thereof wherein they are aligned when the door panels 12 and 14 are near or in the closed position and to bias the first and second door panels into the open position thereof when the door panels are near the open position thereof.

To this end, the spring 52 is formed of a length of spring wire configured to provide a central loop section 54 with end portions 56 extending tangentially therefrom in generally the same direction so that free ends 58 of the end portion 56 are biased in opposite directions towards one another. The free ends 58 of the spring end portions 56 are bent into L-shaped configurations.

The mounting portion 36 of each hinge member 34 includes integral resiliently cantilevered snap connecting elements 60 which are constructed and arranged to receive a corresponding spring free end 58 with a snap fit therein. The snap fit enables each spring free end 58 to pivot with respect to the hinge members about an axis which is parallel with the hinge axis provided by the hinge pin 48. When the hinge members 34 are in the door closed position thereof, as shown in FIG. 2, the opposed stop surfaces 62 are disposed in engagement with one another to establish the closed position of the door panels 12 and 14. In this position, as shown in FIG. 2, it can be seen that the opposed spring forces applied through the snap connecting elements 60 to the hinge member 34 bias the hinge members 34 into the door closed position thereof shown. FIG. 3 shows the position of the parts when the door panels 12 and 14 are in their open position and, here again, it will be noted that the spring 52 applies forces to the hinge members 34 which are directed toward one another so as to resiliently bias the mounting members 34 into the door open position whenever the door panels 12 and 14 are in or near their open position.

FIGS. 2 and 3 also illustrate a handle 64, fixed to the stile 26 of the second door panel 14. The handle is used to manually moved the door panels between the open and closed positions thereof.

Referring now more particularly to FIGS. 6–16, each track structure 20 comprises a track section preferably constructed of a suitable plastic material preferably by an extrusion method or the like. Each track section 20 is configured to provide therein a guide groove, generally indicated at 66, which is T-shaped in cross-sectional configuration. The guide groove 66 includes a central slot 68 opening outwardly having opposed grooves 70 extending transversely in opposite directions from an inner end of the central slot 68.

Figure 6:
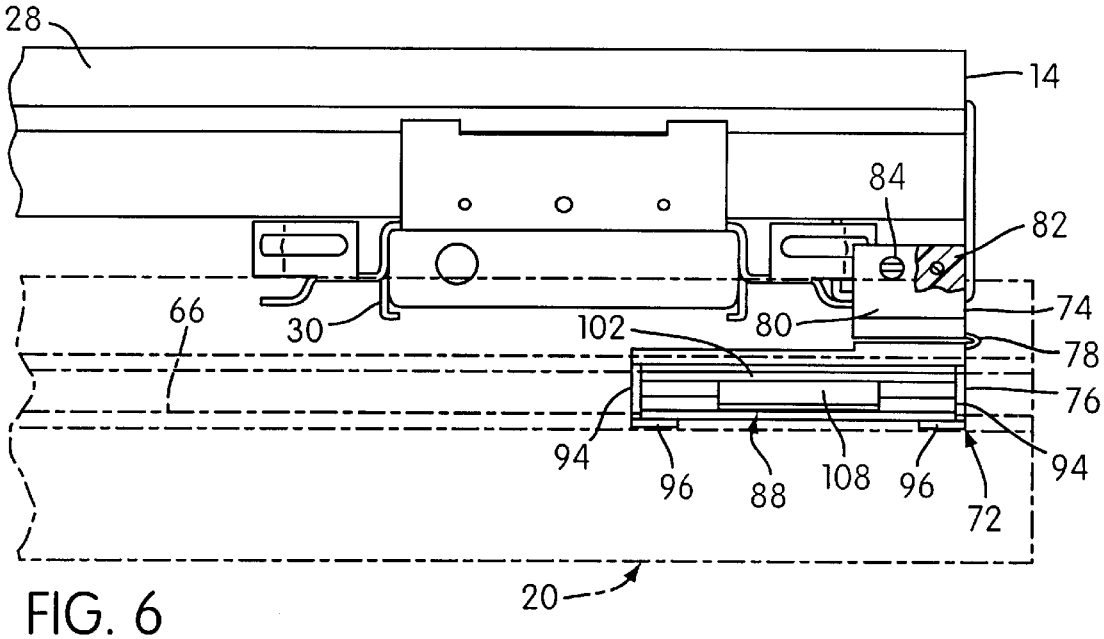
FIG. 6 is a view similar to FIG. 2 showing the guiding structure at the opposite side of the second door panel with the track section in phantom, the guiding structure being shown in the closed door position thereof.
Figure 7:
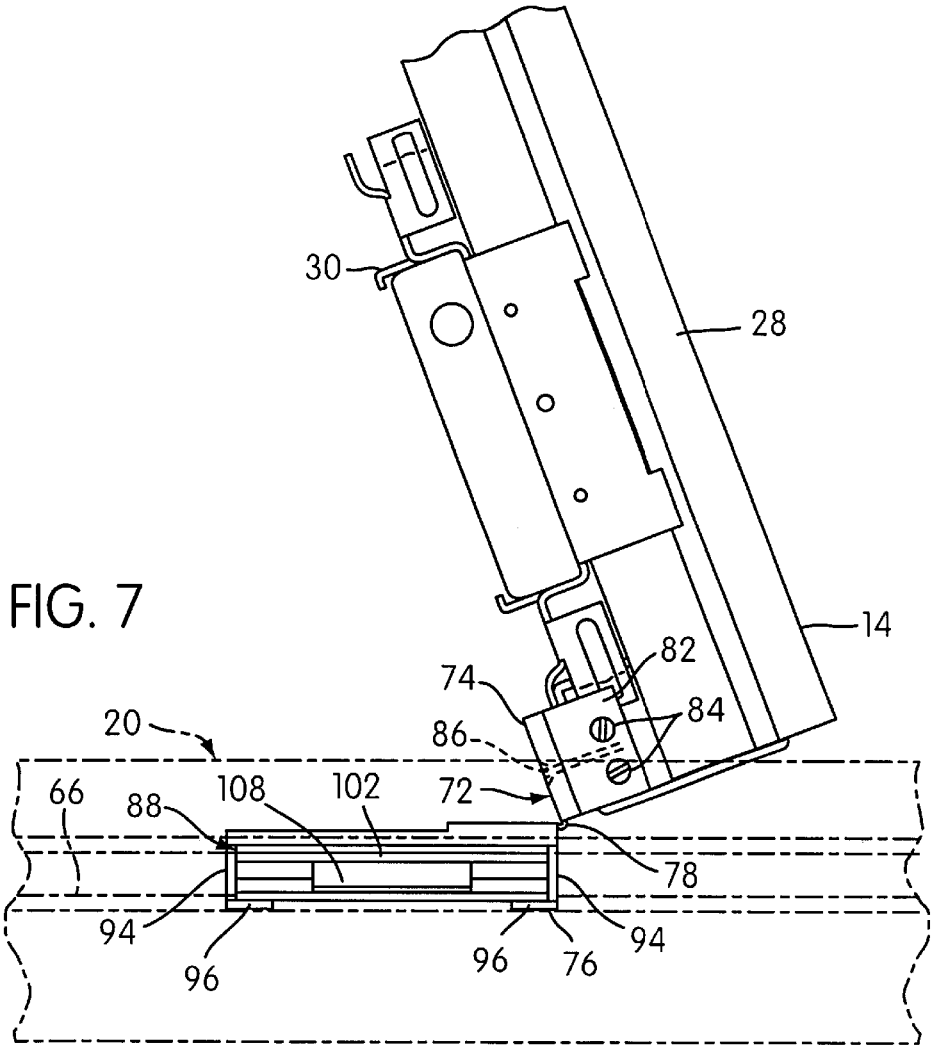
FIG. 7 is a view similar to FIG. 6 showing the guiding structure in the open door position thereof.

The upper and lower guiding structures 22 are of similar construction so that, here again, a description of one should suffice to give an understanding of both. As best shown in FIGS. 6 and 7, the guiding structure 22 comprises a molded plastic mounting member, generally indicated at 72, including a fixed mounting portion 74, a pivoted portion 76 and an elongated thin narrow wall 78 integrally interconnecting the pivoted portion 76 with respect to the fixed mounting portion 74 and establishing the movable vertical axis of the guiding structure 22.

As shown, the mounting portions 74 of the mounting member 72 includes a flange 80 similar 72 to the flange 38 previously described, at one end and an elongated mounting block 82, similar to the mounting block 40, previously described, has its end fixed to the flange 80 as by screws 84. In this way, it becomes possible to insert the mounting block 82 within the hollow end of the outermost vertical rim element and then effect a final fixed securement by threading a screw 86 (see FIG. 7) through the mounting portion 74, the adjacent stile sheet metal and into the mounting block 82.

The guiding structure 22 also includes track engaging structure, generally indicated at 88, which slidably engages within the T-shaped guide groove 66 of the track section 20 for horizontal sliding movement along the track section 20. The pivoted portion 76 is operatively associated with the track engaging structure 88 so as to move horizontally therewith when the track engaging structure 88 moves horizontally along the track section 20 so that the elongated thin narrow wall 80 and the connection of the fixed mounting portion 76 with the opposite side of the second door panel 14 allow the opposite side of the second door panel 14 to pivot about the moving vertical axis established by the elongated thin wall 80 while being moved horizontally thereby as the pivoted portion 76 is moved horizontally with the track engaging structure 88.

The track engaging structure 88 is formed as a part of a sliding member, generally indicated at 90, which in its preferred form is a one-piece molded plastic member. The molded plastic member or sliding member 90 includes a main body part 92 which is mounted on the pivoted portion 76 against horizontal movement in any direction with respect thereto and for vertical movement limited in one direction with respect thereto.

It will be noted that, in order to have the hinge axis of the upper guiding structure 22 aligned with the hinge axis of the lower guide structure 22, the upper and lower mounting members 72 must be mirror images of one another. However, since the sliding member 90 can be mounted downwardly within the upper pivoted portion 76 or upwardly in the lower pivoted portion 76, the sliding member 90 will be identical for both the upper and lower guiding structures 22. It will also be noted that the construction of the upper and lower guiding structures 22 which are mounted on a right hand edge of the second door panel as viewed in FIG. 1 can accommodate a left hand edge simply by reversing the lower guiding structure 22 to the upper guiding structure 22 and vice versa The lower guiding structure 22 will operate with the sliding member 90 in its vertically limited position while the sliding member 90 of the upper guiding structure 22 is allowed to move vertically to accommodate the tolerances in the vertical distance between the upper and lower track structures 20. In this regard, it will be understood that in its broadest aspects the present invention contemplates that the lower guiding structure 22 could be simply a headed pin.

To effect the aforesaid mounting of the sliding member 90 within the pivoted portion 76, the pivoted portion includes parallel side walls 94 having L-shaped inturned flanges 96 along the free edges thereof and a lower end wall 98 extending between the lower ends of the side walls 94. The front surface of the main body part 92 is formed with a pair of parallel grooves 100 which receive the free ends of the L-shaped flanges 96.

Figure 8:
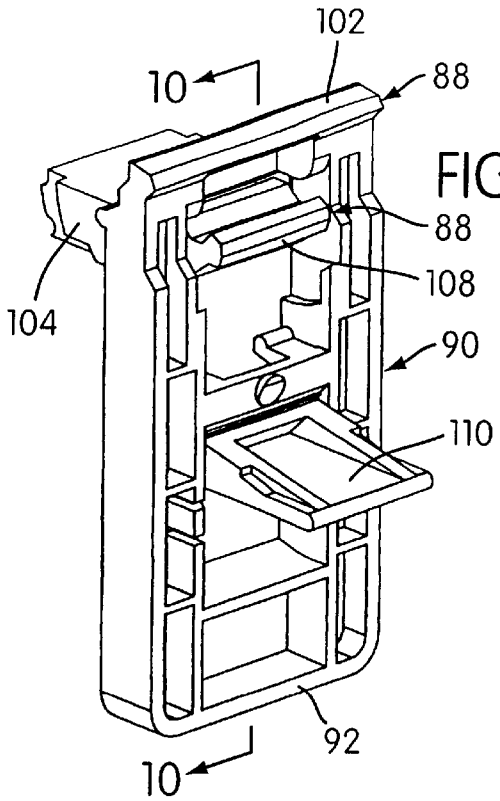
FIG. 8 is a rear perspective view of the sliding member of the guiding structure showing the sliding member in the position in which it is molded.
Figure 9:
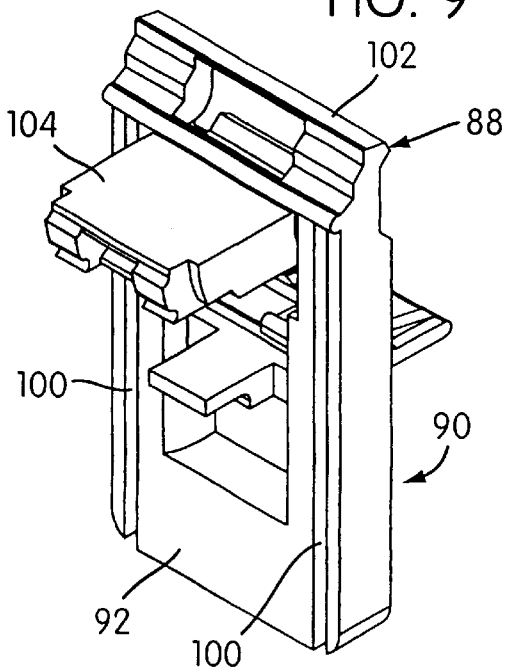
FIG. 9 is a front perspective view of the sliding member shown in FIG. 8.
Figure 10:
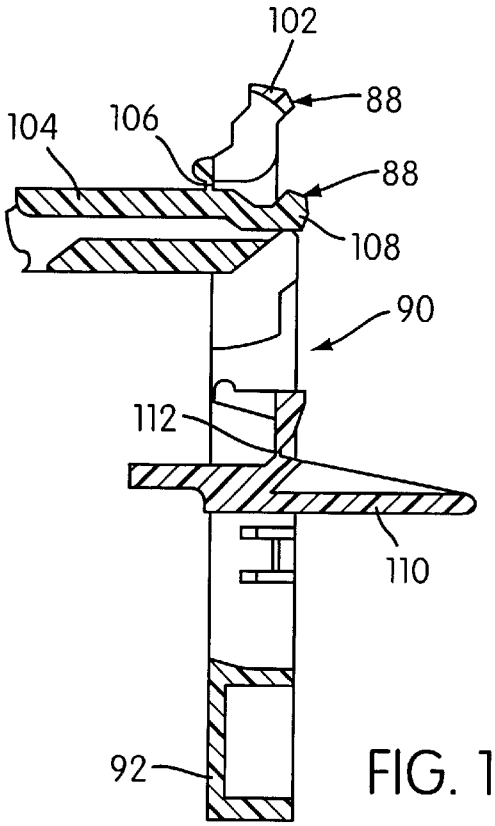
FIG. 10 is a sectional view taken along the line 10—10 of FIG. 8.

As best shown in FIGS. 8–10, the one-piece molded plastic member 90 is molded in the position shown therein. It will be noted that the position enables the component to be molded in a two-piece mold. As shown, the main body part 92 has molded integrally along the upper edge thereof a first flange 102 which constitutes a part of the track engaging structure 88. The one-piece molded plastic member 90 includes a movable part 104 which is connected with the main body part 92 through an elongated thin narrow wall 106 which defines the movement of the movable part 104 with respect to the main body part 92. The movable part 104 includes a second flange 108 integrally formed along its upper edge which constitutes a second part of the track engaging structure 88.

Figure 11:
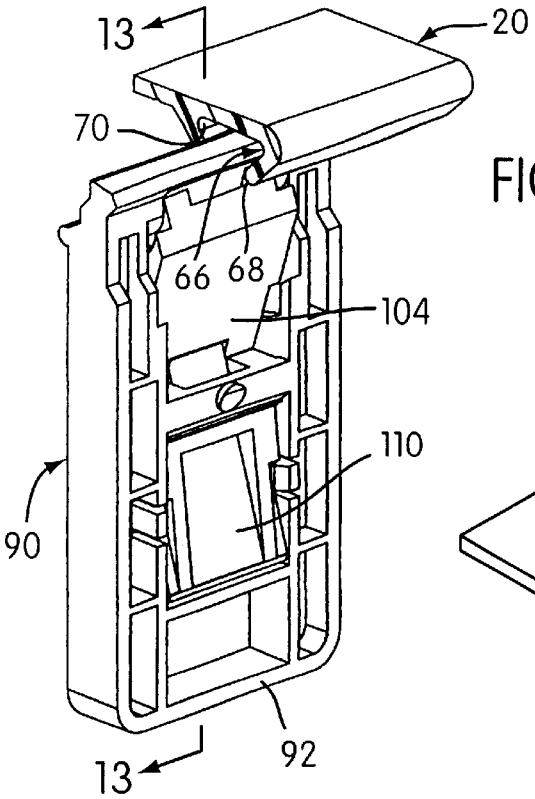
FIG. 11 is a view similar to FIG. 8 showing the sliding member in the insertion position thereof.
Figure 12:
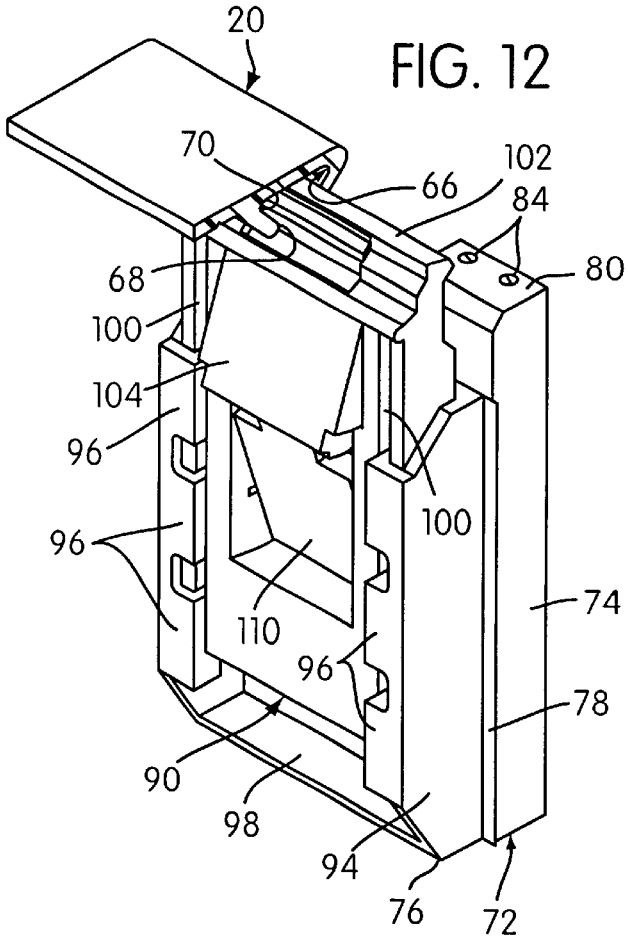
FIG. 12 is a view of the sliding member shown in FIG. 13 mounted within the pivot portion of the plastic mounting member.
Figure 13:
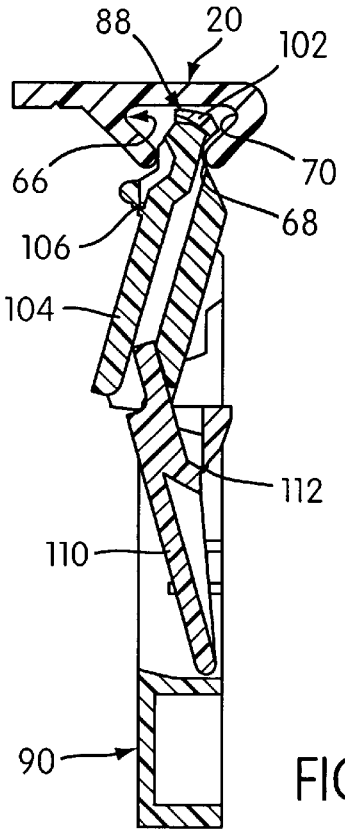
FIG. 13 is a sectional view taken along the line 13—13 of FIG. 11.

The movable part 104 is moved from the molded position shown in FIGS. 8–10 into an insertion position shown in FIGS. 11–13. In the insertion position of the movable part 104, the second flange 108 thereof is disposed in a position which allow the first flange 102 to be moved through the central slot 68 and into an operative position wherein the first flange 102 is disposed in one of the annular grooves 70. After the first flange 70 has been moved into the operative position thereof, the movable part 104 can be moved from the insertion position thereof shown in FIGS. 11–13 to an operative position thereof, shown in FIGS. 14–16 and. In the operative position, the second flange 108 is disposed in an opposite one of the annular grooves 70 to thereby prevent the first flange 102 from being moved out of the operative position thereof without first moving the second flange 108 into the insertion position thereof.

Figure 14:
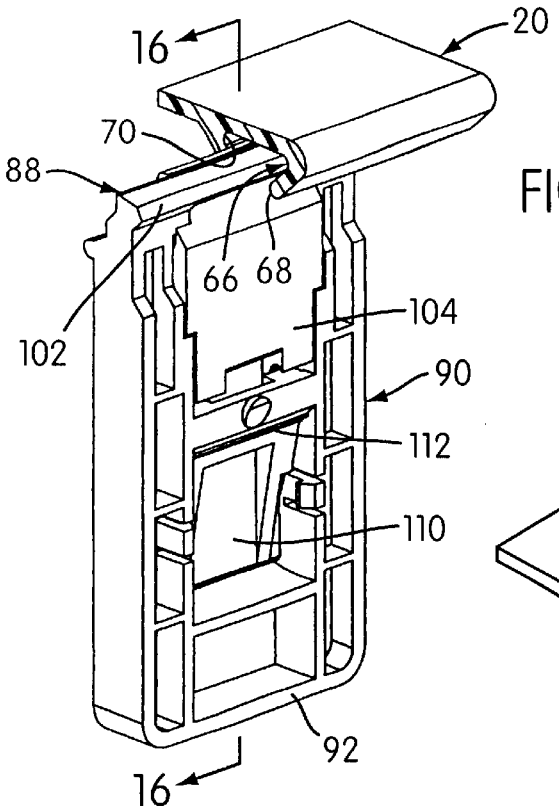
FIG. 14 is a view similar to FIG. 11 showing the sliding member in the operative position thereof.
Figure 15:
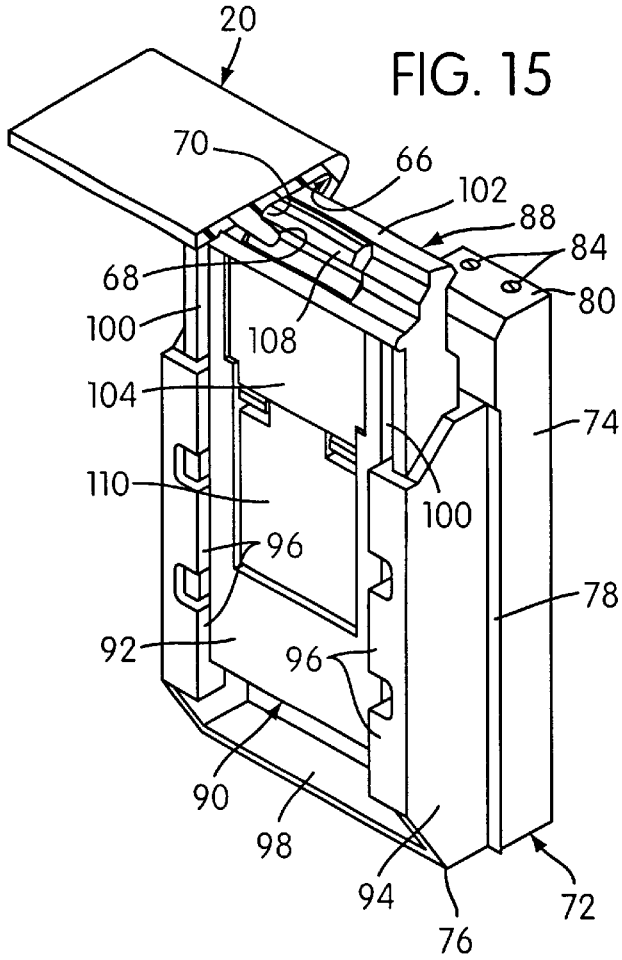
FIG. 15 is a view similar to FIG. 12, showing the sliding member in the operative position thereof.
Figure 16:
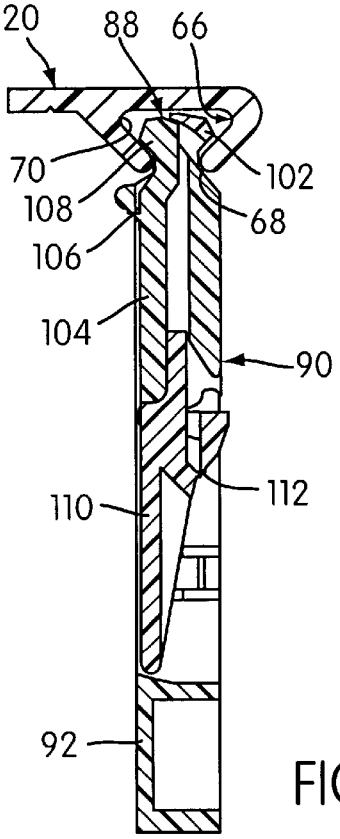
FIG. 16 is a sectional view taken along the line 16—16 of FIG. 14.

The one-piece molded plastic member 90 also includes a releasing part 110 which is connected with the main body part 92 by an integral elongated thin narrow wall 112 enabling the releasing part 110 to be moved in cooperating relation with the movable part 104 from a releasing position as shown in FIGS. 11–13 into an operative position as shown in FIGS. 14–16 in response to the movement of the movable part 104 from the insertion position thereof into the operative position thereof. The releasing part 110 is operable to be manually moved from the operative position thereof into the releasing position thereof to move the movable part from the operative position thereof into the insertion position thereof. This manual movement is accomplished by a simple pushing action on the lower portion of the releasing part which pivots the releasing part about its connecting wall 112. The upper end of the releasing part 110 engages within a hollow lower portion of the movable part 104 so as to effect the movement thereof from the operative position into the lower position.

Any U.S. patents or patent applications mentioned or cited hereinabove are hereby incorporated by reference into the present application.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A bi-fold door assembly comprising first and second door panels, upper and lower pivot structure at one side of said first door panel constructed and arranged to mount said first door panel within a door opening adjacent one side thereof for pivotal movement about a vertical pivotal axis, upper and lower hinge structure between an opposite side of said first door panel and an adjacent side of said second door panel constructed and arranged to hingedly connect said first and second door panels together for relative movement about a vertical hinge axis between a closed position wherein said first and second door panels are disposed generally aligned with one another and an opened position wherein said first and second door panels are disposed generally in side-by-side relation to one another adjacent the one side of the door opening, upper and lower horizontally extending track structure constructed and arranged to be installed in the door opening, upper and lower guiding structure at an opposite side of said second door panel constructed and arranged to guide the opposite side of said second door panel along horizontally extending track structure, said guiding structure being constructed and arranged to allow said second door panel to pivot about a moving vertical axis which is movable horizontally as the opposite side of said second door panel moves along said track structure, each hinge structure including an overcenter spring-biased hinge assembly comprising first and second hinge members including first and second mounting portions fixedly connected with said first and second door panels respectively, interengaging axially aligned hinge portions constructed and arranged to receive a hinge pin therethrough establishing said vertical hinge axis and a spring constructed and arranged to provide oppositely directed spring forces, each spring being constructed and arrange with respect to said first and second hinge members so that the opposed spring forces provided by said spring are applied to said first and second hinge members to bias said first and second door panels into said closed position when said door panels are near said closed position and to bias said first and second door panels into said opened position when said door panels are near said opened position, each spring including a length of spring wire configured to provide a loop section with end portions extending tangentially therefrom in generally the same direction so that the free ends of said end portions are biased in opposite directions toward one another, the free ends of said spring end portions being bent into L-shaped configurations and connected with said mounting portions, each mounting portion of the first and second hinge members includes integral resiliently cantilevered, snap-connecting elements constructed and arranged to receive a corresponding spring free end with a snap fit therein.

2. A bi-fold door assembly comprising first and second door panels, upper and lower pivot structure at one side of said first door panel constructed and arranged to mount said first door panel within a door opening adjacent one side thereof for pivotal movement about a vertical pivotal axis, upper and lower hinge structure between an opposite side of said first door panel and an adjacent side of said second door panel constructed and arranged to hingedly connect said first and second door panels together for relative movement about a vertical hinge axis between a closed position wherein said first and second door panels are disposed generally aligned with one another and an opened position wherein said first and second door panels are disposed generally in side-by-side relation to one another adjacent the one side of the door opening, upper and lower horizontally extending track structure constructed and arranged to be installed in the door opening, upper and lower guiding structure at an opposite side of said second door panel constructed and arranged to guide the opposite side of said second door panel along horizontally extending track structure, said guiding structure being constructed and arranged to allow said second door panel to pivot about a moving vertical axis which is movable horizontally as the opposite side of said second door panel moves along said track structure, each guiding structure comprising a molded plastic mounting member including a fixed mounting portion constructed and arranged to be fixedly mounted on the opposite side of said second door panel, a pivoted portion and an elongated thin narrow wall integrally interconnecting said pivoted portion with respect to said fixed portion and establishing said movable vertical axis, each guiding structure including track engaging structure slidably engaged with an associated track structure for horizontal sliding movement along said track structure, each pivoted portion being operatively associated with an associated track-engaging structure so as to move horizontally along an associated track structure so that an associated elongated thin narrow wall and the connection of said fixed mounting portion with the opposite side of said second door panel allow the opposite side of said second door panel to pivot about the moving vertical axis established by said elongated thin wall while being moved horizontally thereby as said pivoted portion is moved horizontally with said track-engaging structure.

3. A door assembly as defined in claim 2, wherein each track structure includes a track section constructed of plastic material and configured to provide therein a T-shaped guide groove including a central slot opening outwardly having opposed grooves extending transversely in opposite directions from an inner end of said central slot.

4. A door assembly as defined in claim 3 wherein each track-engaging structure includes a first flange extending from an end of an associated pivoted portion configured to be moved through an associated central slot and into an operative position wherein said first flange is disposed in one of said annular grooves and a second flange extending from an end of a sliding member constructed and arranged with respect to said pivoted portion to be moved between an insertion position allowing said first flange to be moved into the operative position thereof and an operative position wherein said second flange is disposed in an opposite one of said annular grooves to thereby prevent said first flange from being moved out of the operative position thereof without first moving said second flange into the insertion position thereof.

5. A hinge assembly for hingedly interconnecting first and second door panels for movement between a closed position wherein said door panels are aligned and an opened position wherein said door panels are side by side, said hinge assembly comprising a pair of hinge members including mounting portions constructed and arranged to be fixed to the first and second door panels respectively, a spring having opposed portions biased toward one another, said hinge members having axially aligned hinge portions, a pivot pin within said hinge portions establishing a hinge axis between said hinge members enabling said hinge members to move between a door closed position corresponding with the closed position of the door panels and a door open position corresponding with the opened position of the door panels, said mounting portions having opposed stop surfaces disposed in engagement with one another to establish the door closed position thereof, said opposed spring portions having pivotal connections with said mounting portions constructed and arranged to provide pivotal axes parallel with the hinge axis provided by said pivot pin so that (1) when said hinge members are in or near the door closed position thereof said spring biases said hinged members into the door closed position thereof and (2) when said hinge members are in or near the door open position thereof said spring biases said hinge members into the door open position thereof, each hinge member is molded of plastic material and each pivotal connection includes integral resiliently cantilevered snap-action elements constructed and arranged to receive a spring portion with a pivotal snap-action fit.

6. A hinge assembly as defined in claim 5 wherein said spring is formed of a metallic wire bent to provide a central loop section having opposite end sections extending generally tangentially from said loop sections, said opposed spring portions being defined by perpendicular bent end portions of said opposite end sections.

7. A hinge assembly as defined in claim 6 wherein said perpendicular bent end portions have perpendicular bent terminal ends thereon.

8. A hinge assembly as defined in claim 7 wherein said pivot pin is formed of plastic material including an elongated headed pin member having integral hook portions extending in resilient cantilever fashion from a non-headed end of said pin member.

9. A hinge assembly as defined in claim 5 wherein said pivot pin is formed of plastic material including an elongated headed pin member having integral hook portions extending in resilient cantilever fashion from a non-headed end of said pin member.

10. A track and guide assembly for controlling a door panel for horizontal rectilinear motion and simultaneous pivotal motion about a vertical axis within a door opening, said trade and guide assembly comprising horizontally extending track structure constructed and arranged to be installed in the door opening, said guiding structure comprising a molded plastic mounting member including a fixed mounting portion constructed and arranged to be fixedly mounted on the door panel, a pivoted portion and an elongated thin narrow wall integrally interconnecting said pivoted portion with respect to said fixed portion and establishing said vertical axis, said guiding structure including track engaging structure slidably engaged with the track structure for horizontal sliding movement along said track structure, said pivoted portion being operatively associated with said track engaging structure so as to move horizontally therewith when said track engaging structure moves horizontally along said track structure so that said elongated thin narrow wall and the connection of said fixed mounting portion with the opposite side of said second door panel allow the opposite side of said second door panel to pivot about the moving vertical axis established by said elongated thin wall while being moved horizontally thereby as said pivoted portion is moved horizontally with said track engaging structure.

11. A door assembly as defined in claim 10 wherein each track structure includes a track section constructed of plastic material and configured to provide therein a T-shaped guide groove including a central slot opening outwardly having opposed grooves extending transversely in opposite directions from an inner end of said central slot.

12. A door assembly as defined in claim 11 wherein each track-engaging structure includes a first flange extending from an end of an associated pivoted portion configured to be moved through an associated central slot and into an operative position wherein said first flange is disposed in one of said annular grooves and a second flange extending from an end of a sliding member constructed and arranged with respect to pivoted portion to be moved between an insertion position allowing said first flange to be moved into the operative position thereof and an operative position wherein said second flange is disposed in an opposite one of said annular grooves to thereby prevent said first flange from being moved out of the operative position thereof without first moving second flange into the insertion position thereof.

13. A track and guide assembly for controlling a door panel for horizontal rectilinear motion and simultaneous pivotal motion about a vertical axis, said track and guide assembly comprising a track section constructed and arranged to be mounted horizontally within a door opening, said track section being constructed of plastic material and configured to provide therein a T-shaped guide groove defined by a central elongated slot opening outwardly having opposed grooves extending transversely in opposite directions from an inner end of said central slot, a guide assembly including fixed mounting structure constructed and arranged to be fixedly connected with the door panel, pivoted structure pivotally connected with said fixed mounting structure for pivotal movement about a vertical axis corresponding to the vertical pivotal axis of the door panel, and track engaging structure slidably mounted in said track section for horizontal movement therealong, said track engaging structure being operatively associated with said pivoted structure to enable the pivoted structure to move horizontally with said track engaging structure, said track engaging structure including a first flange having pivoted structure fixed therewith, said first flange being configured to be moved through said central slot and into an operative position wherein said first flange is disposed in one of said annular grooves and a second flange fixed to a movable structure operatively associated with said pivoted structure to move from (1) an insertion position allowing said first flange to be moved into the operative position thereof and after said first flange has been moved into the operative position into (2) an operative position wherein said second flange is disposed in an opposite one of said annular grooves to thereby prevent said first flange from being moved out of the operative position thereof without first moving said second flange into the insertion position thereof.

14. A track and guide assembly as defined in claim 13 wherein said mounting structure constitutes a mounting portion of a molded plastic mounting member, said mounting member including a pivot portion constituting a portion of said pivoted structure and an elongated thin narrow wall integrally interconnected between said mounting portion and said pivot portion defining said vertical axis.

15. A track and guide assembly as defined in claim 14 wherein said pivoted structure includes a one-piece molded plastic member including a main body part mounted on said pivot portion against horizontal movement in any direction with respect thereto and for vertical movement limited in one direction with respect thereto, said first flange being formed integrally along an edge of said main body part, said movable structure comprising a movable part of said one piece molded plastic member having said second flange integrally formed on an edge thereof connected with said main body part by an elongated thin narrow wall enabling movement of said second flange between the insertion and operative positions thereof.

16. A track and guide assembly as defined in claim 15 wherein said one-piece molded plastic member includes a releasing part connected with said main body part by an integral elongated thin narrow wall enabling said releasing part to be moved in cooperating relation with said movable part from a releasing position into an operative position in response to the movement of said movable part from the insertion position thereof into the operative position thereof, said releasing part being operable to be manually moved from the operative position thereof into the releasing position thereof to move said movable part from the operative position thereof into the insertion position thereof.

17. A track and slide assembly for a door panel for controlling horizontal movement of the door panel back and forth along a rectilinear path comprising a track section constructed of plastic material and configured to provide therein a T-shaped guide groove including a central slot opening outwardly having opposed grooves extending transversely in opposite directions from an inner end of said central slot, a one piece molded plastic member having track engaging structure capable of being detachably mounted on said track section, said one piece molded plastic member including a main body part and a movable part connected with said main body part by an integral elongated thin narrow wall enabling said movable part to pivot with respect to said main body part, said track engaging structure including said track engaging structure including a first flange extending from an end of said main body part configured to be moved through said central slot and into an operative position wherein said first flange is disposed in one of said annular grooves and a second flange extending from an end of said movable part constructed and arranged with respect to main body part to be moved from (1) an insertion position allowing said first flange to be moved into the operative position thereof and after said first flange has been moved into the operative position thereof into (2) an operative position wherein said second flange is disposed in an opposite one of said annular grooves to thereby prevent said first flange from being moved out of the operative position thereof without first moving second flange into the insertion position thereof, movement of said movable part from the operative position thereof into the insertion position thereof enabling said one piece molding to be removed from said track section by withdrawing said first flange from the operative position thereof outwardly of said central slot.

18. A track and slide assembly as defined in claim 7 wherein said one piece molded plastic member includes a releasing part connected with said main body part by an integral elongated thin narrow wall enabling said releasing part to be moved in cooperating relation with said movable part from a releasing position into an operative position in response to the movement of said movable part from the insertion position thereof into the operative position thereof, said releasing part being operable to be manually moved from the operative position thereof into the releasing position thereof to move said movable part from the operative position thereof into the insertion position thereof.

* * * * *